US009780441B2

(12) United States Patent
Komaki et al.

(10) Patent No.: US 9,780,441 B2
(45) Date of Patent: Oct. 3, 2017

(54) ANTENNA AND WIRELESS COMMUNICATION DEVICE

(75) Inventors: Kunihiro Komaki, Kyoto-fu (JP); Masayuki Atokawa, Kyoto-fu (JP); Masahiro Izawa, Kyoto-fu (JP); Yuji Kaminishi, Kyoto-fu (JP); Tsuyoshi Mukai, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 663 days.

(21) Appl. No.: 13/584,601

(22) Filed: Aug. 13, 2012

(65) Prior Publication Data

US 2012/0306703 A1 Dec. 6, 2012

Related U.S. Application Data

(63) Continuation of application No. PCT/JP2010/068887, filed on Oct. 26, 2010.

(30) Foreign Application Priority Data

Feb. 16, 2010 (JP) ..... 2010-031249

(51) Int. Cl.
*H01Q 1/38* (2006.01)
*H01Q 9/42* (2006.01)
(Continued)

(52) U.S. Cl.
CPC ..... *H01Q 1/38* (2013.01); *H01Q 1/2283* (2013.01); *H01Q 5/371* (2015.01); *H01Q 5/378* (2015.01); *H01Q 9/42* (2013.01)

(58) Field of Classification Search
CPC ..... H01Q 1/38; H01Q 5/371; H01Q 1/2283; H01Q 9/42
See application file for complete search history.

(56) References Cited

U.S. PATENT DOCUMENTS 6,950,072 B2 * 9/2005 Miyata et al. ..... 343/702
6,965,350 B2 * 11/2005 Sugiyama et al. ..... 343/767
(Continued)

FOREIGN PATENT DOCUMENTS

JP 2002-158529 A 5/2002
JP 2004-128660 A 4/2004
(Continued)

OTHER PUBLICATIONS

Ting-Wei Kang, et al.; "Chip-Inductor-Embedded Small-Size Printed Strip Monopole for WWAN Operation in the Mobile Phone"; Microwave and Optical Technology Letters; Apr. 2009; pp. 966-971; vol. 51, No. 4.
(Continued)

*Primary Examiner* — Robert Karacsony
*Assistant Examiner* — Amal Patel
(74) *Attorney, Agent, or Firm* — Studebaker & Brackett PC

(57) ABSTRACT

This disclosure provides an antenna and a wireless communication device that includes the antenna in which a high-order mode can be controlled while maintaining good radiation characteristics in both the fundamental mode and high-order mode. The antenna has a radiation electrode provided on a surface of a dielectric substrate and a branch electrode portion that branches from the radiation electrode portion at a branch point near the feeding port toward a vicinity of a position of the radiation electrode at which a maximum voltage of a high-order mode is generated.

14 Claims, 3 Drawing Sheets

(51) Int. Cl.

| | |
|---|---|
| ***H01Q 1/22*** | (2006.01) |
| ***H01Q 5/371*** | (2015.01) |
| ***H01Q 5/378*** | (2015.01) |

(56) References Cited

U.S. PATENT DOCUMENTS

| | | | | |
|---|---|---|---|---|
| 7,046,197 | B2 * | 5/2006 | Okado | H01Q 1/243<br>343/700 MS |
| 2004/0085245 | A1 | 5/2004 | Miyata et al. | |
| 2008/0266189 | A1 | 10/2008 | Wu | |
| 2010/0182202 | A1 * | 7/2010 | Shih | H01Q 9/42<br>343/700 MS |

FOREIGN PATENT DOCUMENTS

| | | | |
|---|---|---|---|
| JP | 20047-128660 | A | 4/2004 |
| JP | 2004-166242 | A | 6/2004 |
| JP | 2007-036338 | A | 2/2007 |
| JP | 4081337 | B2 | 2/2008 |

OTHER PUBLICATIONS

International Search Report; PCT/JP2010/068887; dated Feb. 1, 2011.

Chih-Hua Chang et al.; "Multiband Surface-Mount Chip Antenna Integrated With the Speaker in the Mobile Phone"; Microwave and Optical Technology Letters; Apr. 2008; pp. 1126-1132; vol. 50, No. 4.

* cited by examiner

ANTENNA AND WIRELESS COMMUNICATION DEVICE

CROSS REFERENCE TO RELATED APPLICATIONS

The present application claims priority to International Application No. PCT/JP2010/068887 filed on Oct. 26, 2010, and to Japanese Patent Application No. 2010-031249 filed on Feb. 16, 2010, the entire contents of each of these applications being incorporated herein by reference in their entirety.

TECHNICAL FIELD

The technical field relates to antennas used in a plurality of frequency bands, and in particular to surface mount antennas in which a radiation electrode is formed on a dielectric substrate and wireless communication devices including the antenna.

BACKGROUND

Japanese Unexamined Patent Application Publication No. 2002-158529 (Patent Document 1) discloses an antenna that can be used in a plurality of frequency bands and that has a configuration in which a radiation electrode is formed on the surface of a dielectric substrate.

FIG. 1 is a perspective view of the antenna disclosed in Patent Document 1. Referring to FIG. 1, a surface mount antenna 1 includes a dielectric substrate 2 shaped like a rectangular parallelepiped, a loop radiation electrode 3 and a feeding electrode 4 formed on the dielectric substrate 2. The feeding electrode 4 is formed on a bottom surface 2*c* and a side surface 2*b* of the dielectric substrate 2 in such a manner as to extend toward a top surface 2*a* through the side edge area of the side surface 2*b*. The radiation electrode 3 is formed in the form of a loop on the rectangular top surface 2*a* in such a manner as to extend from the feeding electrode 4 along the vicinity of the sides of the top surface 2*a*. An open end 3*a* of the loop radiation electrode 3 is arranged in such a manner as to face a feeding end side protruding electrode 18 with a predetermined distance therebetween so as to generate a capacitance between the open end 3*a* and the feeding end side protruding electrode.

SUMMARY

This disclosure provides an antenna and a wireless communication device including the antenna that can allow high-order mode control to be performed while maintaining good fundamental mode and high-order mode radiation characteristics.

An antenna according to an embodiment of the disclosure includes a radiation electrode provided on a dielectric substrate and including a first end adapted as a feeding port and a second open end. A branch electrode is provided on the dielectric substrate. The branch electrode branches from the radiation electrode at a branch point near the feeding port toward a vicinity of a position of the radiation electrode at which a maximum voltage of a high-order mode is generated.

In a more specific embodiment, part of the branch electrode may be parallel with and close to a vicinity of the open end of the radiation electrode.

In another more specific embodiment, the dielectric substrate may have a substantially rectangular parallelepiped shape, the radiation electrode may extend through a side surface of the dielectric substrate and extend around sides (perimeter) of a top surface of the dielectric substrate, and the branch electrode may be formed on a top surface of the dielectric substrate.

In yet another more specific embodiment, a direction from the branch point to a tip of the branch electrode may be opposite to a direction from the feeding port to a tip of the radiation electrode in a portion where the branch electrode and the radiation electrode are (parallel with and) close to each other.

In another more specific embodiment, a passive electrode coupled to the radiation electrode may be provided on the dielectric substrate.

A wireless communication device according to the present invention includes: the antenna having any of the above-described configurations, a circuit substrate on which the antenna is provided, and a casing housing the circuit substrate.

DETAILED DESCRIPTION

In the antenna disclosed in Patent Document 1, the open end of the radiation electrode is made to face the feeding end, thereby providing a capacitance forming portion, and a high-order mode frequency is independently controlled using the generated capacitance. Hence, the gap width and length of the capacitance forming portion need to be changed to control the high-order mode resonant frequency. The inventors realized, however, that when the high-order mode frequency is controlled, the resonant frequency of the fundamental mode is also changed, resulting in a low degree of frequency control independence.

In addition, with this configuration, there is no freedom with regard to the arrangement of the open end since the open end faces the feeding end.

Further, the position of the open end of the radiation electrode has a considerable influence on radiation characteristics. Hence, forming a capacitance for high-order mode control may result in sacrificing both fundamental mode and high-order mode radiation characteristics.

Figure 1:
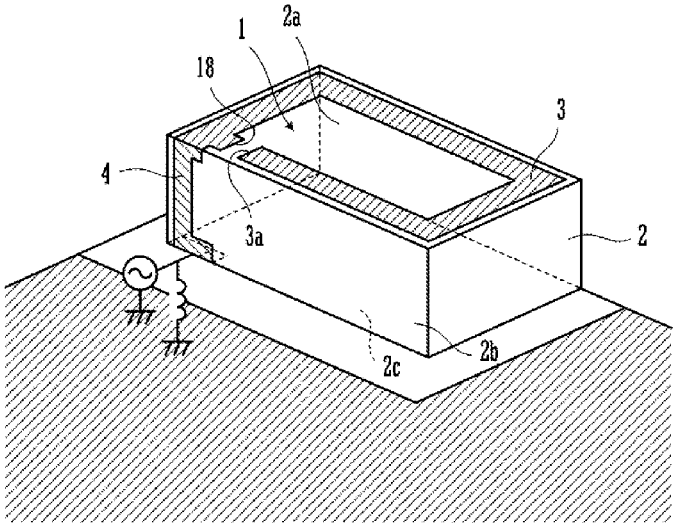
FIG.1 Prior Art
FIG. 1 is a perspective view of an antenna disclosed in Patent Document 1.
Figure 2:
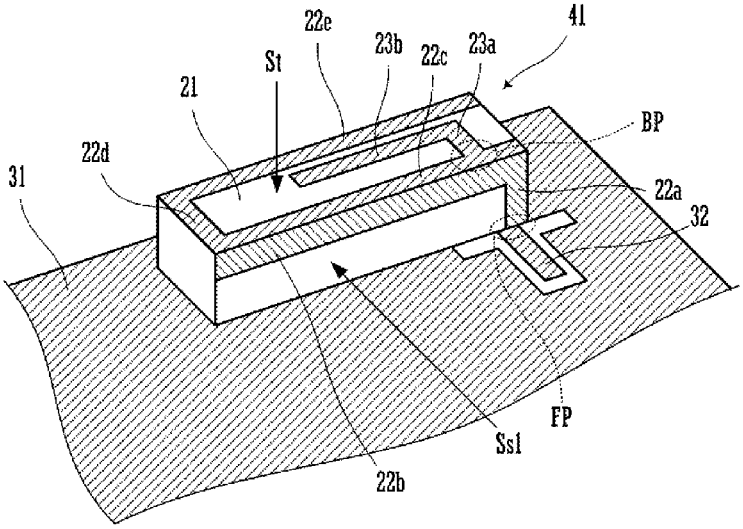
FIG. 2 is a perspective view of an antenna in a mounted state according to a first exemplary embodiment.

Embodiments consistent with the present disclosure can address the above-mentioned problems related to mode control and degradation of radiation characteristics. FIG. 2 is a perspective view of an antenna 41 in a mounted state according to a first exemplary embodiment. The antenna 41 has a configuration in which predetermined pattern electrodes are formed on a surface of a dielectric substrate 21. The dielectric substrate 21 is shaped like a rectangular parallelepiped and is formed of a dielectric ceramic material or a composite of a dielectric ceramic powder and an organic material.

One of the predetermined pattern electrodes is a radiation electrode. This radiation electrode is formed of a plurality of radiation electrode portions, as described below. A radiation electrode portion 22*a* that extends upward from a feeding port FP and a radiation electrode portion 22*b* that is connected to the radiation electrode portion 22*a* and extends along an upper edge of the dielectric substrate 21 are provided on a side surface Ss1 of the dielectric substrate 21. Provided on a top surface St of the dielectric substrate 21 are a radiation electrode portion 22*c* that is connected to (i.e., continues from) the radiation electrode portion 22*b* along an upper edge of the dielectric substrate 21, and radiation electrode portions 22*d* and 22*e* that continue from the radiation electrode portion 22*c* in such a manner as to extend around the sides (i.e., around the perimeter) of the top surface of the dielectric substrate 21.

In this manner, a radiation electrode is formed in an electrode pattern that extends from the feeding port FP along a path constituted by the radiation electrode portions 22*a*, (22*b*+22*c*), 22*d*, and 22*e*. This radiation electrode operates as a radiation electrode one end of which is fed at the feeding port FP and the other end of which is open. Hereinafter, the entirety of the radiation electrode formed of the radiation electrode portions 22*a*, 22*b*, 22*c*, 22*d*, and 22*e* will be referred to as a "radiation electrode 22."

The other of the predetermined pattern electrodes is a branch electrode. This branch electrode is formed of a plurality of branch electrode portions, as described below. A branch electrode portion 23*a* that branches at a right angle from the radiation electrode portion 22*c* at a branch point BP near the feeding port and a branch electrode portion 23*b* that continues from the branch electrode portion 23*a* and extends in parallel with and closest or proximal to the radiation electrode portion 22*e* are formed on the top surface of the dielectric substrate 21. Hereinafter, the entirety of the branch electrode formed of the branch electrode portions 23*a* and 23*b* will be referred to as a "branch electrode 23."

In this manner, part of the branch electrode 23 that branches from the radiation electrode 22 at the branch point BP near the feeding port is arranged in parallel with and close to the open end of the radiation electrode 22. The branch electrode 23 branches toward a point (position) on the radiation electrode 22 at which a high-order mode maximum voltage is generated.

The direction from the branch point BP of the branch electrode 23 toward the tip of the branch electrode 23 is opposite to the direction from the feeding port FP of the radiation electrode 22 toward the tip of the radiation electrode 22, i.e., the directions are parallel and are opposite directions, in the portion where the branch electrode 23 is parallel with and close to the radiation electrode 22. This structure increases the likelihood that a capacitance is generated in the portion where the branch electrode 23 is parallel with and close to the radiation electrode 22. Further, the usage of opposite directions allows the currents flowing through the capacitance portion to have the same direction, whereby current distribution characteristics in the electrodes become good in both the fundamental mode and high-order mode.

A circuit substrate 31 has a ground electrode formed thereon, and the antenna 41 is mounted near an edge of the circuit substrate 31. The circuit substrate 31 has a feeding circuit provided thereon. A feeding line 32 is part of the feeding circuit. The feeding port of the antenna 41 is connected to the feeding line 32.

Note that although the antenna 41 is mounted on the ground electrode in this example, by providing a ground electrode non-forming area on the circuit substrate 31, the antenna 41 may be mounted in that area.

As a result of the structure described above, a capacitance is generated between the radiation electrode portion 22*e* and the branch electrode portion 23*b*. In other words, a structure is realized in which a capacitance is added (loaded) at a predetermined position on the radiation electrode 22.

For example, in the fundamental mode, the radiation electrode 22 resonates in a ¼-wavelength mode, and in this fundamental mode, there exists a voltage distribution in which the voltage has the maximum amplitude at the tip of the radiation electrode 22. In the high-order mode, the radiation electrode 22 resonates in, for example, a ¾-wavelength mode. This high-order mode has a voltage distribution in which the voltage amplitude becomes its maximum at the tip of the radiation electrode 22, and there exist the other maximum-voltage point (antinode) near the feeding port and a minimum-voltage point (node) between the two maximum-voltage points.

The voltage amplitude of the fundamental mode is small (at least smaller than that near the open end) at the maximum-voltage point (antinode) of the high-order mode near the feeding port. Hence, by arranging the branch electrode close to this maximum-voltage point (antinode) of the high-order mode near the feeding port, the frequency of the high-order mode can be set to a desired value with almost no effect on the fundamental mode.

In this manner, the high-order mode can be controlled independently of the fundamental mode using the capacitance loading position on the radiation electrode 22. In other words, as a result of a capacitance being loaded at or near a point at which the maximum voltage of the high-order mode used is generated, the resonant frequency of the high-order mode can be controlled (set) so as to be decreased. On the other hand, regarding the fundamental mode, since the capacitance is loaded at a position at which the voltage amplitude is lower (electric energy is not concentrated) compared with in case of the high-order mode, the resonant frequency of the fundamental mode is negligibly affected. As a result, the degree of independence of high-order mode control can be increased.

Further, although the position of the open end of the radiation electrode 22 affects the radiation characteristics in both the fundamental mode and high-order mode, the open end of the radiation electrode 22 is not used for control of the high-order mode in the present invention. Hence, the open end of the radiation electrode 22 can be arranged freely. As a result, a radiation electrode with good radiation characteristics in both the fundamental mode and high-order mode can be provided.

Note that since the radiation electrode 22 is formed in such a manner as to extend around the sides (perimeter) of the top surface of the dielectric substrate 21 and the branch electrode 23 is formed on the top surface of the dielectric substrate 21, the main portion of the radiation electrode 22 and the branch electrode 23 are formed on the same surface, whereby the precision with which the two patterns are formed is kept high. As a result, variations in the radiation characteristics of the fundamental mode and high-order mode can be suppressed.

The circuit substrate 31 can have a wireless communication circuit formed thereon and the antenna 41 connected to the wireless communication circuit. The wireless communication circuit can be the high-frequency circuit of, for example, a cellular phone. The circuit substrate 31 can be housed in the casing of a wireless communication device.

Figure 3:
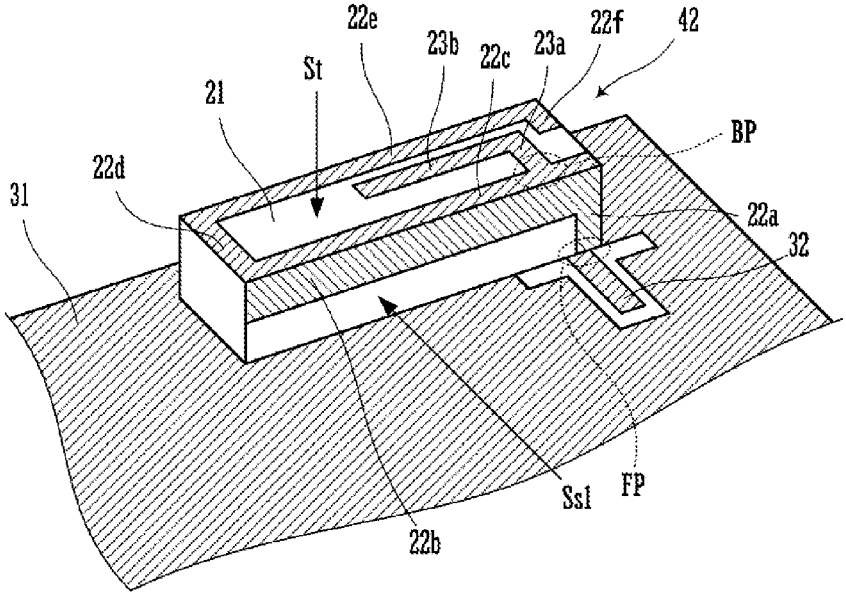
FIG. 3 is a perspective view of an antenna in a mounted state according to a second exemplary embodiment.

FIG. 3 is a perspective view of an antenna 42 in a mounted state according to a second exemplary embodiment. The shape of a radiation electrode 22 is different from that of the antenna 41 illustrated in FIG. 2 of the first exemplary embodiment. In the example illustrated in FIG. 3, the radiation electrode 22 includes the radiation electrode portions 22*a* and 22*b* provided on the side surface Ss1 of the dielectric substrate 21, and radiation electrode portions 22*c*, 22*d*, 22*e*, and 22*f* are provided on the top surface St of the dielectric substrate 21.

In the example illustrated in FIG. 3, the open end of the radiation electrode 22 is arranged in a portion that extends further from the radiation electrode portion 22*e* that is parallel with the branch electrode portion 23*b*.

In this manner, the open end of the radiation electrode 22 can be freely arranged irrespective of the position of the feeding port FP.

Figure 4:
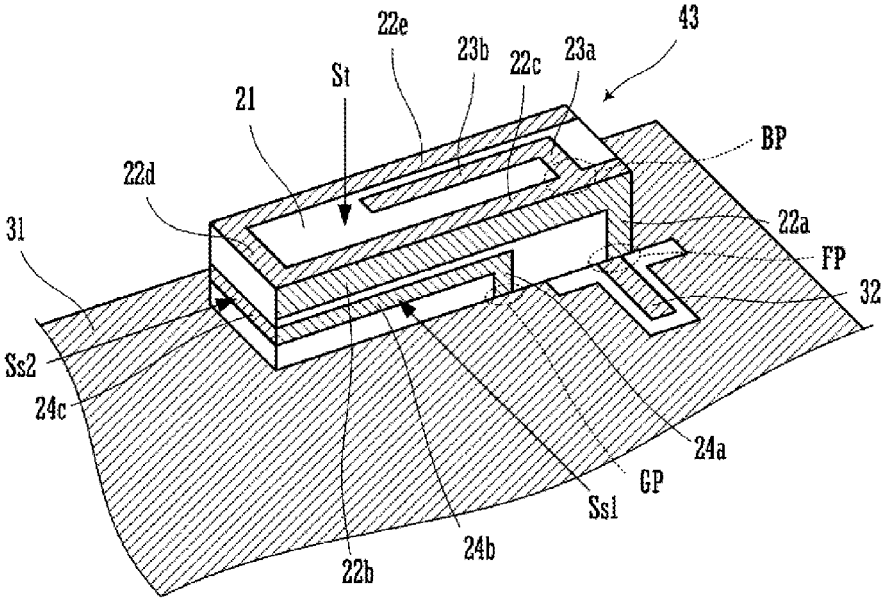
FIG. 4 is a perspective view of an antenna in a mounted state according to a third exemplary embodiment.

FIG. 4 is a perspective view of an antenna 43 in a mounted state according to a third exemplary embodiment. Unlike the antenna 41 illustrated in FIG. 2 of the first exemplary embodiment, a passive electrode is further provided on the dielectric substrate 21.

In the example illustrated in FIG. 4, on the side surface Ss1 of the dielectric substrate 21, a passive electrode portion 24*a* that extends upward from a ground port GP and a passive electrode portion 24*b* that is connected to the passive electrode portion 24*a* and arranged in parallel with the radiation electrode portion 22*b* are formed. A passive electrode portion 24*c* one end of which is connected to the passive electrode portion 24*b* and the other end of which is open is formed on a side surface Ss2 of the dielectric substrate 21. Hereinafter, the entirety of a passive electrode formed of the passive electrode portions 24*a*, 24*b*, and 24*c* will be referred as a "passive electrode 24."

The passive electrode 24 is coupled to the radiation electrode portion 22*b* in a portion where the radiation electrode portion 22*b* and the passive electrode 24*b* are parallel with each other, and operates as an (additional) radiation electrode different from the radiation electrode 22. Hence, a gain can be obtained in a predetermined frequency band that is different from the two frequency bands corresponding to the fundamental mode and high-order mode of the radiation electrode 22.

Figure 5:
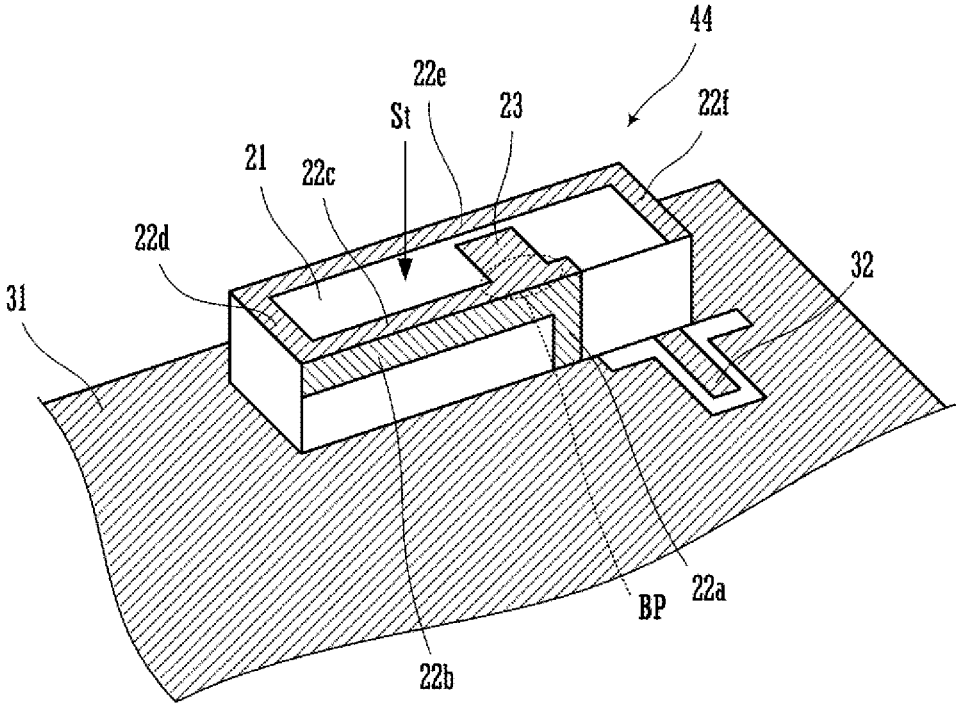
FIG. 5 is a perspective view of an antenna in a mounted state according to a fourth exemplary embodiment.

FIG. 5 is a perspective view of an antenna 44 in a mounted state according to a fourth exemplary embodiment. The shape of a branch electrode 23 is different from that of the antenna 41 illustrated in FIG. 2 of the first exemplary embodiment. In the example illustrated in FIG. 5, the branch electrode 23 that branches at a right angle from a radiation electrode portion 22*c* at a branch point BP near the feeding port is provided on the top surface St of the dielectric substrate 21. A capacitance is generated between the tip of the branch electrode 23 and a point (position) on the radiation electrode 22 at which the maximum voltage of the high-order mode is generated.

In this manner, the branch electrode 23 may be configured to face a predetermined position (radiation electrode portion 22*e*) of the radiation electrode 22 only at the tip of the branch electrode 23.

In embodiments consistent with the disclosure, since the branch electrode forms a capacitance for controlling the high-order mode, the high-order mode can be controlled independently, whereby the degree of independence of control of the fundamental mode and control of the high-order mode is increased.

Further, since the high-order mode is controlled by the branch electrode, the open end of the radiation electrode can be arranged freely, whereby the radiation electrode having good radiation characteristics in both the fundamental mode and high-order mode can be realized.

That which is claimed is:

1. An antenna, comprising:

a radiation electrode provided on a dielectric substrate and including a first end adapted as a feeding port and a second end adapted as an open end; and a branch electrode provided on the dielectric substrate, wherein the branch electrode branches from the radiation electrode at a branch point, the branch point being nearer, along a conductive path of the radiation electrode, to the first end than the second end, the branch point is nearer to a position along the conductive path of the radiation electrode at which a maximum voltage of a high-order mode is generated than to a position along the conductive path of the radiation electrode at which a minimum voltage of the high-order mode is generated, the branch electrode branches from a long side of the radiation electrode and a distal end of the branch electrode points to a short side of the radiation electrode, a gap between the distal end of the branch electrode and the radiation electrode differs in width along the conductive path, and the open end of the radiation electrode extends to an edge of the dielectric substrate, wherein the dielectric substrate has substantially rectangular parallelepiped shape, wherein the radiation electrode extends through a side surface of the dielectric substrate and extends around sides of a top surface of the dielectric substrate, wherein the branch electrode is provided on the top surface of the dielectric substrate, and wherein the high-order mode corresponds with the radiation electrode resonating in a ¾-wavelength mode.

2. The antenna according to claim 1, wherein part of the branch electrode is parallel with and close to a vicinity of the open end of the radiation electrode.

3. The antenna according to claim 2, wherein a direction of current from the branch point to a tip of the branch electrode is opposite to a direction of current from the feeding port to a tip of the radiation electrode in a portion where the branch electrode and the radiation electrode are close to each other.

4. The antenna according to claim 2, wherein a passive electrode coupled to the radiation electrode is provided on the dielectric substrate.

5. A wireless communication device comprising:

the antenna according to claim 2;

a circuit substrate on which the antenna is provided; and a casing housing the circuit substrate.

6. The antenna according to claim 1, wherein a direction of current from the branch point to a tip of the branch electrode is opposite to a direction of current from the feeding port to a tip of the radiation electrode in a portion where the branch electrode and the radiation electrode are close to each other.

7. The antenna according to claim 1, wherein a passive electrode coupled to the radiation electrode is provided on the dielectric substrate.

8. A wireless communication device comprising:

the antenna according to claim 1;

a circuit substrate on which the antenna is provided; and a casing housing the circuit substrate.

9. An antenna, comprising:

a radiation electrode provided on a dielectric substrate and including a first end adapted as a feeding port and a second end adapted as an open end; and a branch electrode provided on the dielectric substrate, wherein the branch electrode branches from the radiation electrode at a branch point, the branch point being nearer, along a conductive path of the radiation electrode, to the first end than the second end, the branch point is nearer to a position along the conductive path of the radiation electrode at which a maximum voltage of a high-order mode is generated than to a position along the conductive path of the radiation electrode at which a minimum voltage of the high-order mode is generated, the branch electrode branches from a long side of the radiation electrode and a distal end of the branch electrode points to a short side of the radiation electrode, a gap between the distal end of the branch electrode and the radiation electrode differs in width along the conductive path, and the open end of the radiation electrode extends to an edge of the dielectric substrate, wherein a direction of current from the branch point to a tip of the branch electrode is opposite to a direction of current from the feeding port to a tip of the radiation electrode in a portion where the branch electrode and the radiation electrode are closest to each other so that a capacitance is generated in the portion where the branch electrode is parallel with and close to the radiation electrode, wherein the capacitance is generated at or near a point at which the maximum voltage of the high-order mode is generated, and wherein the branch electrode and the radiation electrode are provided on a same surface of the dielectric substrate.

10. The antenna according to claim 9, wherein a passive electrode coupled to the radiation electrode is provided on the dielectric substrate.

11. A wireless communication device comprising:

the antenna according to claim 9;

a circuit substrate on which the antenna is provided; and a casing housing the circuit substrate.

12. An antenna, comprising:

a radiation electrode provided on a dielectric substrate and including a first end adapted as a feeding port and a second end adapted as an open end; and a branch electrode provided on the dielectric substrate, wherein the branch electrode branches from the radiation electrode at a branch point, the branch point being nearer, along a conductive path of the radiation electrode, to the first end than the second end, the branch point is nearer to a position along the conductive path of the radiation electrode at which a maximum voltage of a high-order mode is generated than to a position along the conductive path of the radiation electrode at which a minimum voltage of the high-order mode is generated, the branch electrode branches from a long side of the radiation electrode and a distal end of the branch electrode points to a short side of the radiation electrode, a gap between the distal end of the branch electrode and the radiation electrode differs in width along the conductive path, and the open end of the radiation electrode extends to an edge of the dielectric substrate, wherein a passive electrode coupled to the radiation electrode is provided on the dielectric substrate, and wherein the high-order mode corresponds with the radiation electrode resonating in a ¾-wavelength mode.

13. A wireless communication device comprising:

the antenna according to claim 12;

a circuit substrate on which the antenna is provided; and a casing housing the circuit substrate.

14. An antenna, comprising:

a radiation electrode provided on a dielectric substrate and including a first end adapted as a feeding port and a second end adapted as an open end; and a branch electrode provided on the dielectric substrate, wherein the branch electrode branches from the radiation electrode at a branch point, the branch point being nearer, along a conductive path of the radiation electrode, to the first end than the second end, the branch point is nearer to a position along the conductive path of the radiation electrode at which a maximum voltage of a high-order mode is generated than to a position along the conductive path of the radiation electrode at which a minimum voltage of the high-order mode is generated, the branch electrode branches from a long side of the radiation electrode and a distal end of the branch electrode points to a short side of the radiation electrode, a gap between the distal end of the branch electrode and the radiation electrode differs in width along the conductive path, and the open end of the radiation electrode extends to an edge of the dielectric substrate, wherein the open end is located on a short side of the dielectric substrate that is opposite the short side of the radiation electrode, and wherein the high-order mode corresponds with the radiation electrode resonating in a ¾-wavelength mode.

* * * * *